US009975160B2

(12) United States Patent
Robbins

(10) Patent No.: US 9,975,160 B2
(45) Date of Patent: May 22, 2018

(54) EXTRUSION PRESS CONTAINER AND LINER FOR SAME

(71) Applicant: Exco Technologies Limited, Markham (CA)

(72) Inventor: Paul Henry Robbins, Port Perry (CA)

(73) Assignee: EXCO TECHNOLOGIES LIMITED, Markham (CA)

( * ) Notice: Subject to any disclaimer, the term of this patent is extended or adjusted under 35 U.S.C. 154(b) by 263 days.

(21) Appl. No.: 13/621,583

(22) Filed: Sep. 17, 2012

(65) Prior Publication Data

US 2013/0074568 A1 Mar. 28, 2013

Related U.S. Application Data

(60) Provisional application No. 61/535,602, filed on Sep. 16, 2011.

(51) Int. Cl.
*B21C 23/21* (2006.01)
*B21C 27/00* (2006.01)
*B21C 29/02* (2006.01)

(52) U.S. Cl.
CPC ..... *B21C 23/21* (2013.01); *B21C 27/00* (2013.01); *B21C 29/02* (2013.01)

(58) Field of Classification Search
CPC ..... B21C 29/02; B21C 29/04; B21C 23/21; B21C 27/00; B21C 29/00; B21C 23/212; B21C 23/215
USPC ..... 72/272, 253.1, 342.1, 342.7, 342.8, 72/342.92
See application file for complete search history.

(56) References Cited

U.S. PATENT DOCUMENTS 2,960,221 A * 11/1960 Albers et al. ..... 72/272
3,042,195 A * 7/1962 Muller ..... 72/272
3,089,591 A * 5/1963 Groos ..... 72/272
3,161,756 A * 12/1964 Haverkamp et al. ..... 219/422
3,360,975 A * 1/1968 Edgecombe ..... B21C 29/02 72/272
3,364,707 A * 1/1968 Foerster ..... 72/38
3,478,562 A * 11/1969 Groos ..... 72/272
4,007,619 A * 2/1977 Ames et al. ..... 72/272
4,064,723 A * 12/1977 Larsson et al. ..... 72/60
(Continued)

FOREIGN PATENT DOCUMENTS

CH 414506 A * 6/1966 ..... B21C 29/02
CN 202087620 12/2011
(Continued)

*Primary Examiner* — Teresa M Ekiert
*Assistant Examiner* — Gregory Swiatocha
(74) *Attorney, Agent, or Firm* — Young Basile Hanlon & MacFarlane, P.C.

(57) ABSTRACT

A liner for an extrusion press container that includes an elongate body having a longitudinally extending passage therein through which a billet is advanced, the passage having a generally rectangular cross-sectional profile. The liner further comprises at least one first longitudinally extending heating element accommodated by the body adjacent a first side of the passage, and at least one second longitudinally extending heating element accommodated by the body adjacent a second side of the passage. The first and second heating elements are individually controllable for controlling a thermal profile within the liner.

28 Claims, 12 Drawing Sheets

(56) References Cited

U.S. PATENT DOCUMENTS

| | | | | | |
|---|---|---|---|---|---|
| 4,882,104 | A * | 11/1989 | Dobrowsky | ..... | B29C 47/92 264/209.1 |
| 5,311,761 | A * | 5/1994 | Robbins | ..... | B21C 26/00 72/273 |
| 5,600,990 | A * | 2/1997 | Kelly et al. | ..... | 72/255 |
| 7,272,967 | B2 * | 9/2007 | Robbins | ..... | 72/272 |
| 7,594,419 | B2 * | 9/2009 | Robbins | ..... | B21C 29/02 72/272 |
| 2005/0262913 | A1 | 12/2005 | Robbins | | |

FOREIGN PATENT DOCUMENTS

| | | | | | |
|---|---|---|---|---|---|
| DE | 102007033205 | A1 * | 2/2008 | ..... | B21C 25/02 |
| EP | 481951 | | 4/1992 | | |
| EP | 481951 | A2 * | 4/1992 | | |
| EP | 0481951 | A2 * | 4/1992 | ..... | B21C 27/00 |
| JP | 62-161421 | | 7/1987 | | |
| JP | 4-274820 | B2 | 6/2009 | | |

* cited by examiner

EXTRUSION PRESS CONTAINER AND LINER FOR SAME

CROSS-REFERENCE TO RELATED APPLICATIONS

This application claims the benefit of U.S. Provisional Application No. 61/535,602 to Robbins filed on Sep. 16, 2011 and entitled "Extrusion Press Container and Liner for Same", the entire content of which is incorporated herein by reference.

FIELD OF THE INVENTION

The present invention relates to a metal extrusion and in particular, to an extrusion press container and a liner for same related to metal extrusion.

BACKGROUND

Metal extrusion presses are well known in the art, and are used for forming extruded metal products having cross-sectional shapes that generally conform to the shape of the extrusion dies used. A typical metal extrusion press comprises a generally cylindrical container having an outer mantle and an inner tubular liner. The container serves as a temperature controlled enclosure for a billet during extrusion. An extrusion ram is positioned adjacent one end of the container. The end of the extrusion ram abuts a dummy block, which in turn abuts the billet allowing the billet to be advanced through the container. An extrusion die is positioned adjacent the opposite end of the container.

During operation, once the billet is heated to a desired extrusion temperature (typically 800-900° F. for aluminum), it is delivered to the extrusion press. The extrusion ram is then activated to abut the dummy block thereby to advance advancing the billet into the container and towards the extrusion die. Under the pressure exerted by the advancing extrusion ram and dummy block, the billet is extruded through the profile provided in the extrusion die until all or most of the billet material is pushed out of the container, resulting in the extruded product.

In order to attain cost-saving efficiency and productivity in metal extrusion technologies, it is important to achieve thermal alignment of the extrusion press. Thermal alignment is generally defined as the control and maintenance of optimal running temperature of the various extrusion press components. Achieving thermal alignment during production of extruded product ensures that the flow of the extrudable material is uniform, and enables the extrusion press operator to press at a higher speed with less waste.

As will be appreciated, optimal billet temperature can only be maintained if the container can immediately correct any change in the liner temperature during the extrusion process, when and where it occurs. Often all that is required is the addition of relatively small amounts of heat to areas that are deficient.

A number of factors must be considered when assessing the thermal alignment of an extrusion press. For example, the whole of the billet of extrudable material must be at the optimum operating temperature in order to assure uniform flow rates over the cross-sectional area of the billet. The temperature of the liner in the container must also serve to maintain, and not interfere with, the temperature profile of the billet passing therethrough.

Achieving thermal alignment is generally a challenge to an extrusion press operator. During extrusion, the top of the container usually becomes hotter than the bottom. Although conduction is the principal method of heat transfer within the container, radiant heat lost from the bottom surface of the container rises inside the container housing, leading to an increase in temperature at the top. As the front and rear ends of the container are generally exposed, they will lose more heat than the center section of the container. This may result in the center section of the container being hotter than the ends. As well, the temperature at the extrusion die end of the container tends to be slightly higher compared to the ram end, as the billet heats it for a longer period of time. These temperature variations in the container affect the temperature profile of the liner contained therein, which in turn affects the temperature of the billet of extrudable material. The temperature profile of the extrusion die generally conforms to the temperature profile of the liner, and the temperature of the extrusion die affects the flow rate of extrudable material therethrough. Although the average flow rate of extrudable material through the extrusion die is governed by the speed of the ram, flow rates from hotter sections of the billet will be faster compared to cooler sections of the billet. The run-out variance across the cross-sectional profile of a billet can be as great as 1% for every 5° C. difference in temperature. This can adversely affect the shape of the profile of the extruded product. Control of the temperature profiles of the liner and of the container is therefore of great importance to the efficient operation of the extrusion process.

Other challenges arise when the liner passage is non-circular. For example, liners having a rectangular passage, referred to as "rectangular liners", are used for extruding shapes having generally flat profiles. A conventional approach to forming a rectangular liner involves inserting a pair of liner inserts into an otherwise circular liner. For example, FIGS. 1*a* and 1*b* show a prior art container 10 for an extrusion press that comprises a cylindrical mantle 12 and a tubular liner 14 having a passage 16 extending therethrough for receiving a billet. The passage 16 has a generally circular cross-section. A pair of inserts 18 is secured within the interior of the passage by bolts 19 passing through the mantle 12 and the liner 14. Each of the inserts 18 comprises a curved outer surface 18*a* complimentary to and engaging an inner surface 14*a* of the liner 14, and a flat inner surface 18*b*. The flat inner surfaces 18*b* of the inserts 18 and exposed sections of the inner surface 14*a* of the liner 14 together define a generally rectangular passage through liner 14, as may be better seen in FIG. 2.

Such "multiple-piece" rectangular liners are known to have drawbacks. For example, stress cracks readily form in the liner 14 along the corners of the rectangular passage during use, which in turn can propagate into the mantle 12, particularly around the vicinity of bolts 19. Additionally, dead metal zones can form at the corners of the rectangular passage, causing metal impurities to be deposited at the corners of the passage. These impurities can be transferred to the extruded product, resulting in an increase in the amount of scrap of extruded product.

Single-piece rectangular liners have been previously considered. For example, U.S. Pat. No. 3,892,114 to Taniguchi et al. discloses a container for use in an extrusion press of the type comprising an inner cylinder having a noncircular opening and an outer cylinder applied about the inner cylinder by shrinkage fit. A plurality of circumferential recesses are provided for the inner or outer cylinder at the interface between them at portions corresponding to the portions of the noncircular opening having small pressure receiving areas. The recess has a predetermined radial depth and extends along the entire axial length of the inner and outer cylinders.

Prior art single-piece rectangular liners typically have high failure rates owing to increased stresses in the liner at the corners of the rectangular passage. This failure typically takes the form of cracking in the liner in the vicinity of these corners. These cracks can eventually propagate from the liner into the mantle, necessitating replacement of both the liner and the mantle and resulting in costly downtime.

Some approaches to resolving the issue of cracking in single-piece rectangular liners have also been previously considered. For example, U.S. Pat. No. 4,007,619 to Ames et al. discloses a container for an extrusion press comprising a liner space having its shape defined by at least one, if desirable several, component parts in which in the liner wall where the highest stresses arise there is provided at least one groove or similar recess. The at least one groove runs approximately in the extrusion direction, and is filled and sealed with a weld which behaves elastically during extrusion. The intrusion of extruded metal into the gaps is thus prevented and a longer lifetime of the container is achieved.

As will be appreciated, improvements to address the problems discussed above are generally desired. It is therefore an object of the present invention at least to provide a novel extrusion press container and a liner for same.

SUMMARY

Accordingly, in one aspect there is provided a liner for use in a metal extrusion press, the liner comprising: an elongate body having a longitudinally extending passage therein through which a billet is advanced, the passage having a generally rectangular cross-sectional profile; and at least one first longitudinally extending heating element accommodated by the body adjacent a first side of the passage and at least one second longitudinally extending heating element accommodated by the body adjacent a second side of the passage, the first and second heating elements being individually controllable for controlling a thermal profile within the liner.

The generally rectangular cross-sectional profile of the passage may have a width defining a transverse axis, the first and second heating elements being positioned on opposite sides of the transverse axis. The first and second heating elements may be arranged in at least one row adjacent the passage. The at least one row may be parallel to the transverse axis.

The liner may further comprise at least one first longitudinally extending temperature sensor adjacent the first side of the passage and at least one second longitudinally extending temperature sensor adjacent the second side of the passage. The at least one first temperature sensor may be positioned between the at least one first heating element and the passage. The at least one second temperature sensor may be positioned between the at least one second heating element and the passage. The first and second temperature sensors may be thermocouples.

The generally rectangular cross-sectional profile may comprise rounded corners. The generally rectangular cross-sectional profile may comprise rounded sides. The generally rectangular cross-sectional profile may comprise flared ends.

At least one of the first and second heating elements may comprise at least one heating section.

Each of the first and second heating elements may comprise two heating sections positioned towards each relative end of the heating element.

In another aspect, there is provided a container for use in a metal extrusion press, the container comprising: an outer mantle configured for connecting to an extrusion press and having a central axial bore therein; and a liner comprising an elongate body having a longitudinally extending passage therein through which a billet is advanced, the passage having a generally rectangular cross-sectional profile, and at least one first longitudinally extending heating element accommodated by the body adjacent a first side of the passage and at least one second longitudinally extending heating element accommodated by the body adjacent a second side of the passage, the first and second heating elements being individually controllable for controlling a thermal profile within the liner.

The generally rectangular cross-sectional profile of the passage may have a width defining a transverse axis, the first and second heating elements being positioned on opposite sides of the transverse axis. The first and second heating elements may be arranged in at least one row adjacent the passage. The at least one row may be parallel to the transverse axis.

The container may further comprise at least one first longitudinally extending temperature sensor adjacent the first side of the passage and at least one second longitudinally extending temperature sensor adjacent the second side of the passage. The at least one first temperature sensor may be positioned between the at least one first heating element and the passage. The at least one second temperature sensor may be positioned between the at least one second heating element and the passage. The first and second temperature sensors may be thermocouples.

The generally rectangular cross-sectional profile may comprise rounded corners. The generally rectangular cross-sectional profile may comprise rounded sides. The generally rectangular cross-sectional profile may comprise flared ends. At least one of the first and second heating elements may comprise at least one heating section.

Each of the first and second heating elements may comprise two heating sections positioned towards each relative end of the heating element.

The mantle may comprise a plurality of additional longitudinally extending heating elements adjacent the liner. The plurality of additional longitudinally extending heating elements may be arranged circumferentially about an axial bore of the mantle.

BRIEF DESCRIPTION OF THE DRAWINGS

Embodiments will now be described more fully with reference to the accompanying drawings in which.

DETAILED DESCRIPTION

Figure 1A:
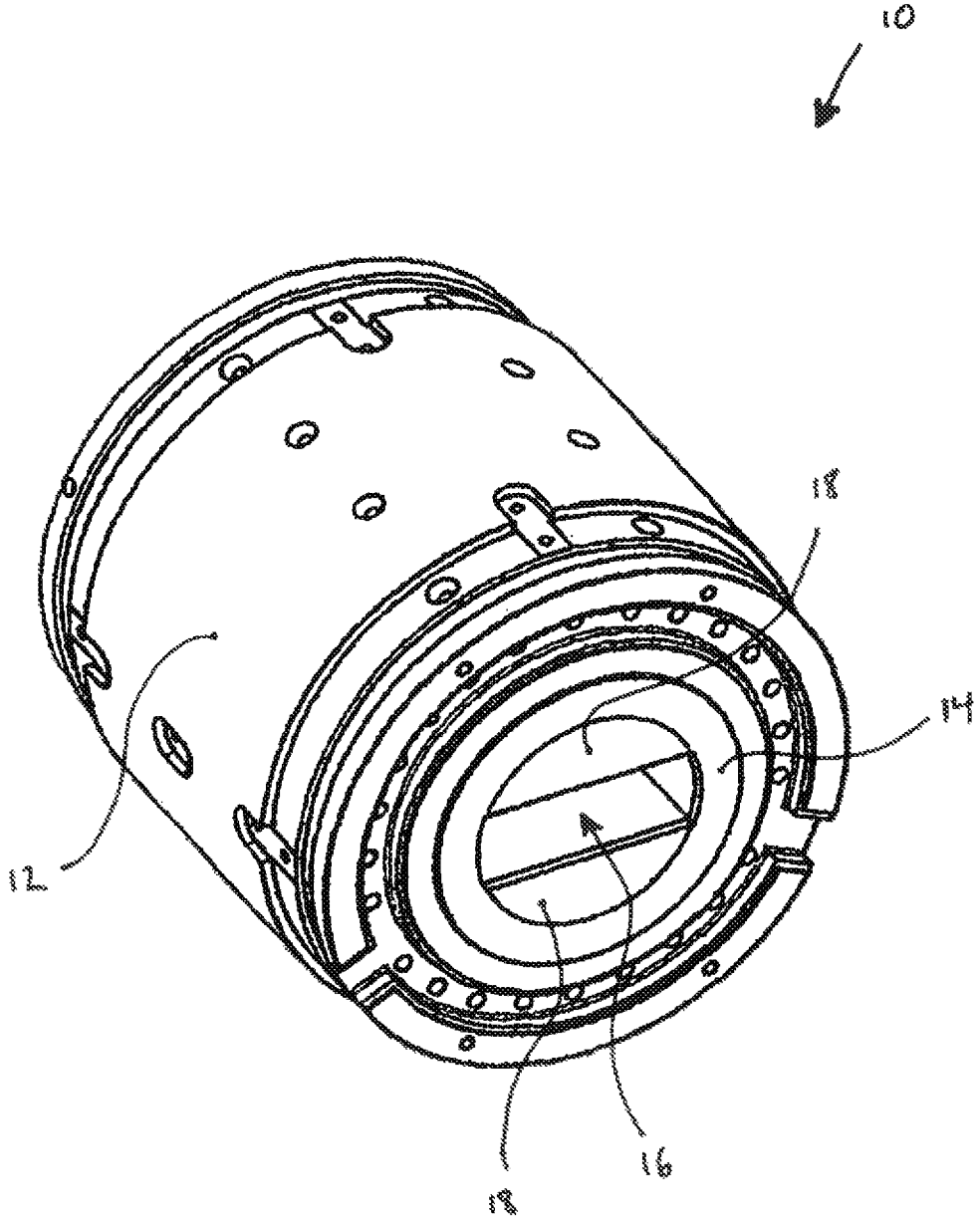
Figure 1a (PRIOR ART)
FIGS. 1*a* and 1*b* are perspective and front sectional views, respectively, of a prior art extrusion container.
Figure 1B:
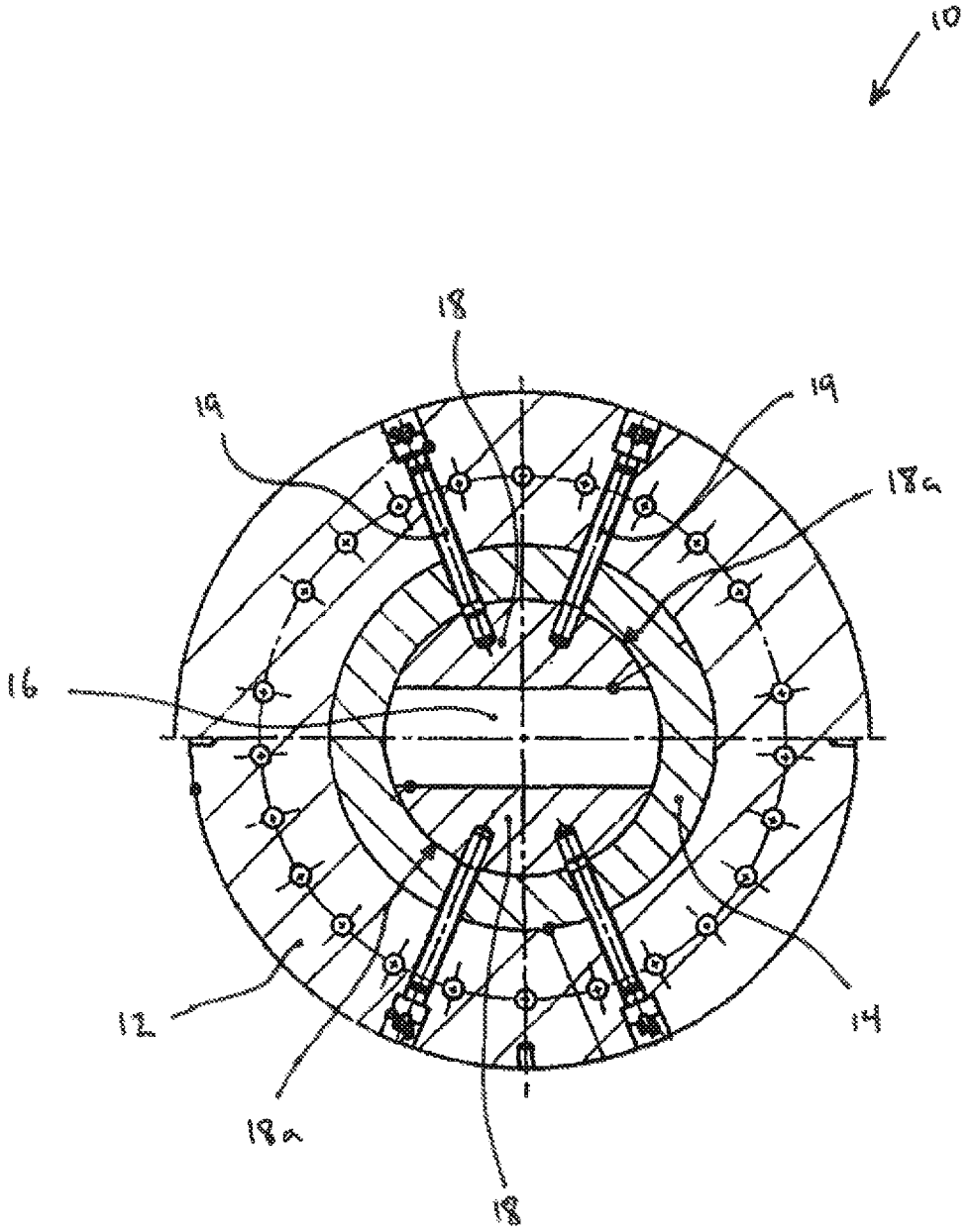
Figure 1b (PRIOR ART)
Figure 2:
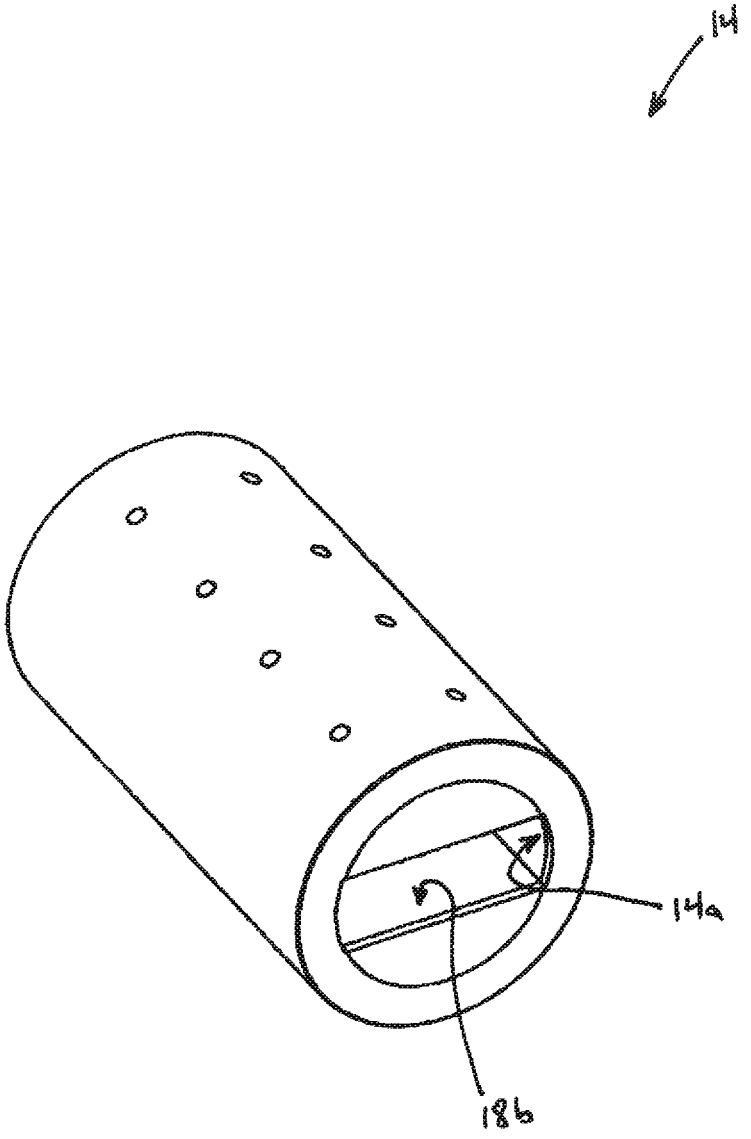
Figure 2 (PRIOR ART)
FIG. 2 is a perspective view of a prior art liner forming part of the extrusion container of FIG. 1.
Figure 3:
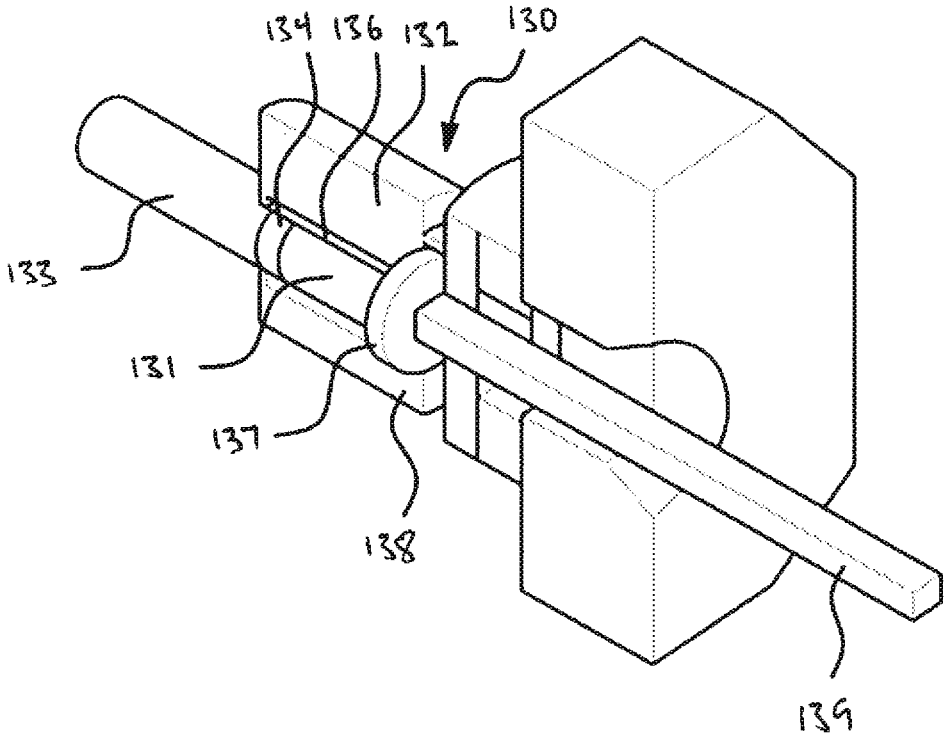
FIG. 3 is a schematic perspective view of a metal extrusion press.

FIG. 3 is a simplified illustration of an extrusion press for use in metal extrusion. The extrusion press comprises a container 130 having an outer mantle 132 that surrounds an inner tubular liner 136. The container 130 serves as a temperature controlled enclosure for a billet 131 during extrusion of the billet. An extrusion ram 133 is positioned adjacent one end of the container 130. The end of the extrusion ram 133 abuts a dummy block 134, which in turn abuts the billet 131 allowing the billet to be advanced through the container 130. An extrusion die 137 is positioned adjacent a die end 138 of the container 130.

During operation, once the billet 131 is heated to a desired extrusion temperature (typically 800-900° F. for aluminum), it is delivered to the extrusion press. The extrusion ram 133 is then actuated to abut the dummy block 134, thereby to advance the billet 131 into the container and towards the extrusion die 137. Under the pressure exerted by the advancing extrusion ram 133 and dummy block 134, the billet 131 is extruded through the profile provided in the extrusion die 137 until all or most of the billet material is pushed out of the container 130, resulting in the extruded product 139.

Figure 4:
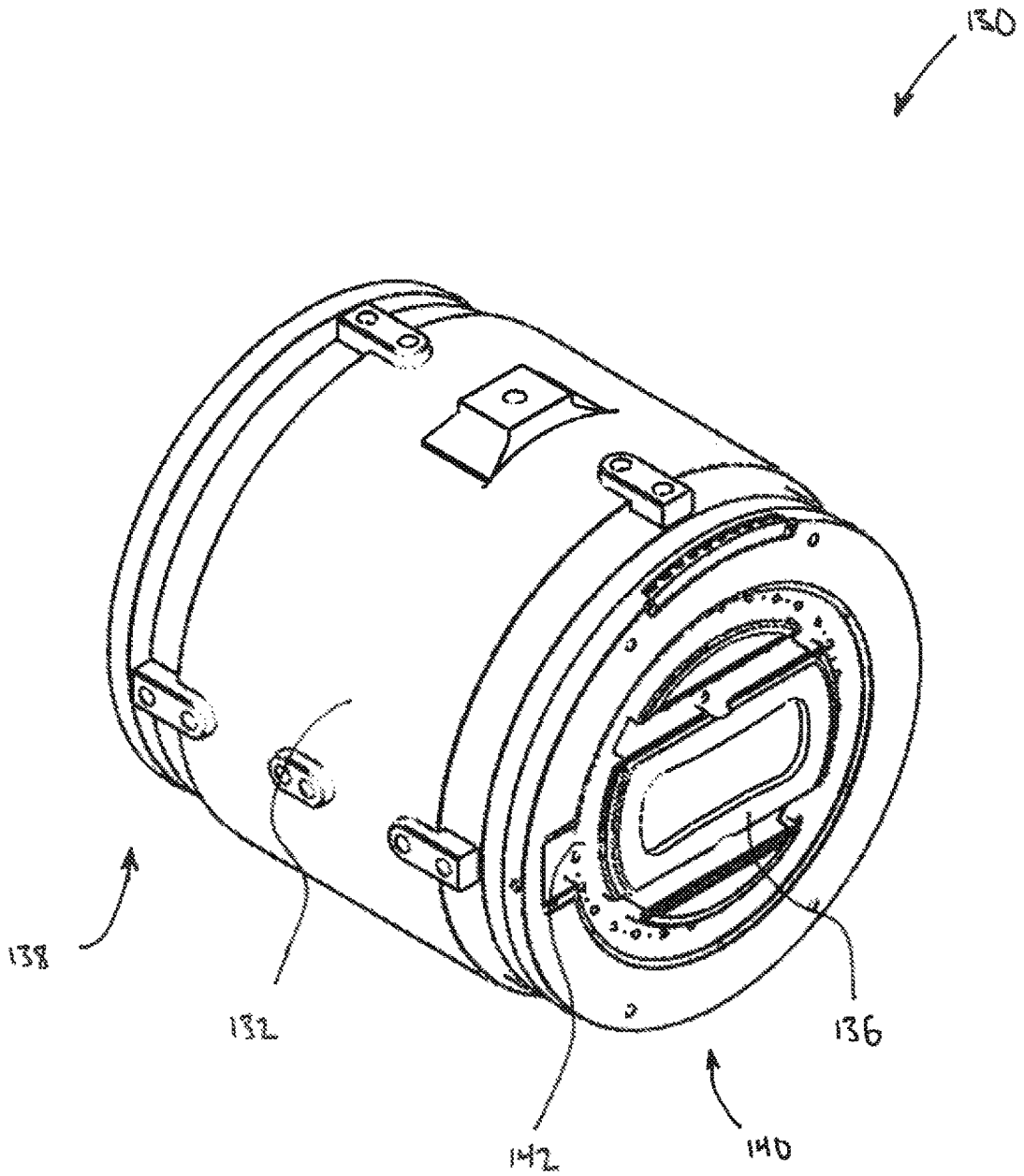
FIG. 4 is a perspective view of a container forming part of the metal extrusion press of FIG. 3.
Figure 5:
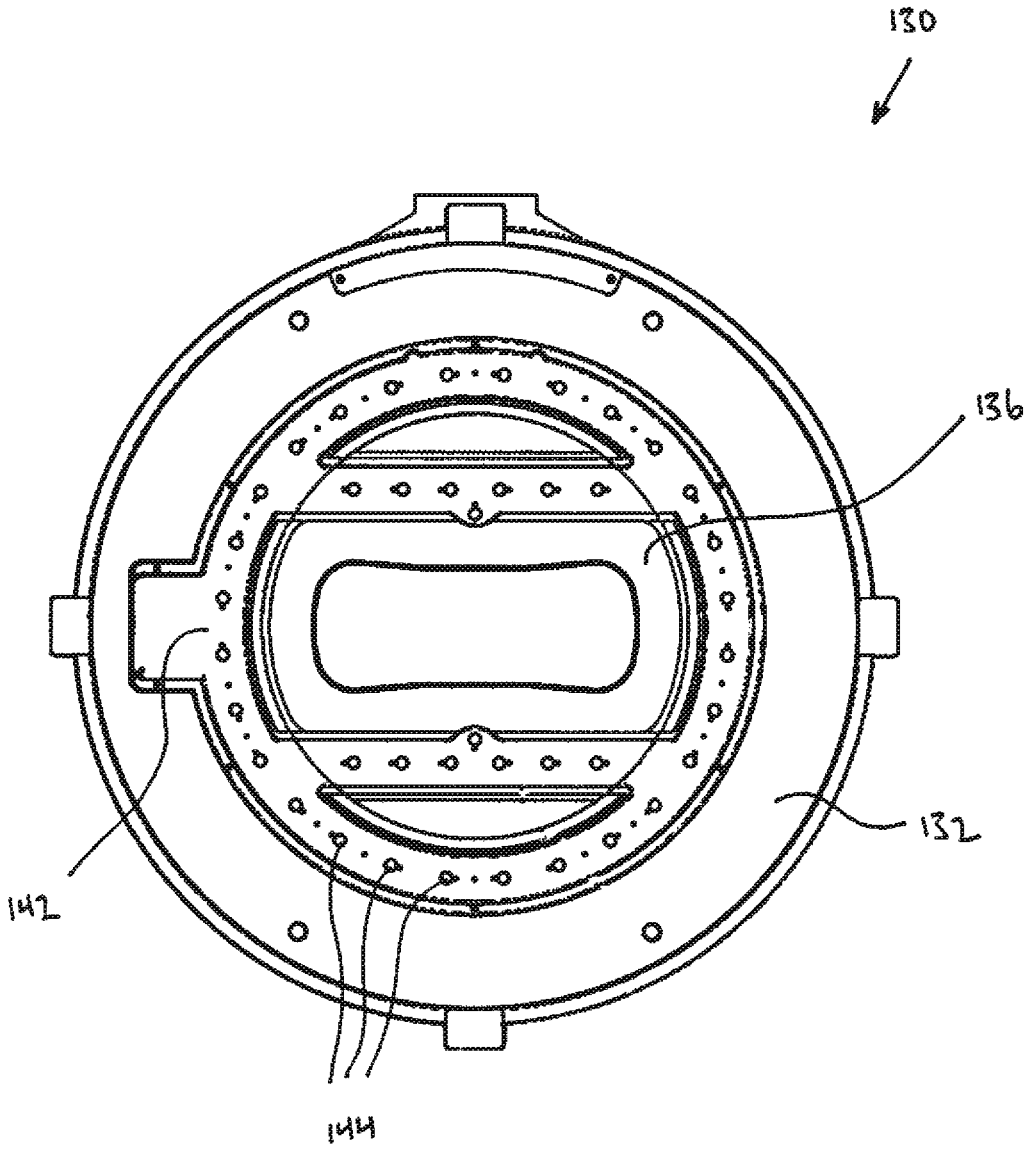
FIG. 5 is a front elevational view of the container of FIG. 4.
Figure 6:
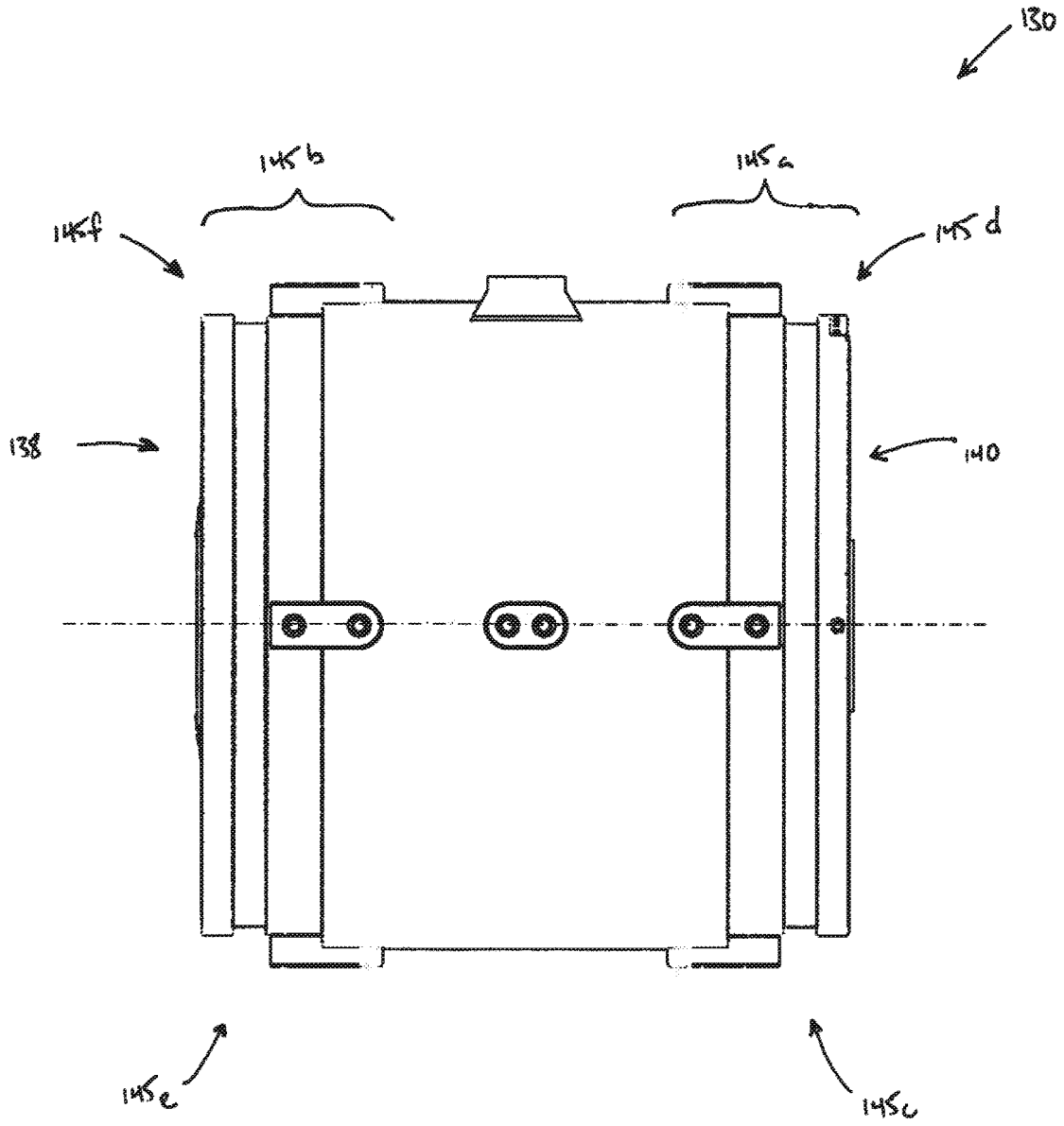
FIG. 6 is a side elevational view of the container of FIG. 4.

FIGS. 4 to 6 better illustrate the container 130. In this embodiment, the mantle 132 and the liner 136 are shrunk-fit together to form the container 130. The container 130 is configured at the die end 138, and along the side sections thereof, in a manner known in the art to facilitate coupling of the container 130 to the extrusion press.

At the ram end 140 of the mantle 132, an annular recess 142 for passage of bus lines (not shown) is provided in the interior surface of the mantle. The ram end 140 is further configured to accommodate cover plates to protect the bus lines accommodated by the channel. Within the annular recess 142, there is provided a plurality of longitudinal bores 144 extending the length of the mantle 132. The longitudinal bores 144 are positioned circumferentially about the axial bore of the mantle that accommodates the liner 136. Each longitudinal bore 144 is shaped to accommodate an elongate heating element 146 that can be energized to provide thermal energy to the mantle 132 and to the liner 136 during use.

Figure 7:
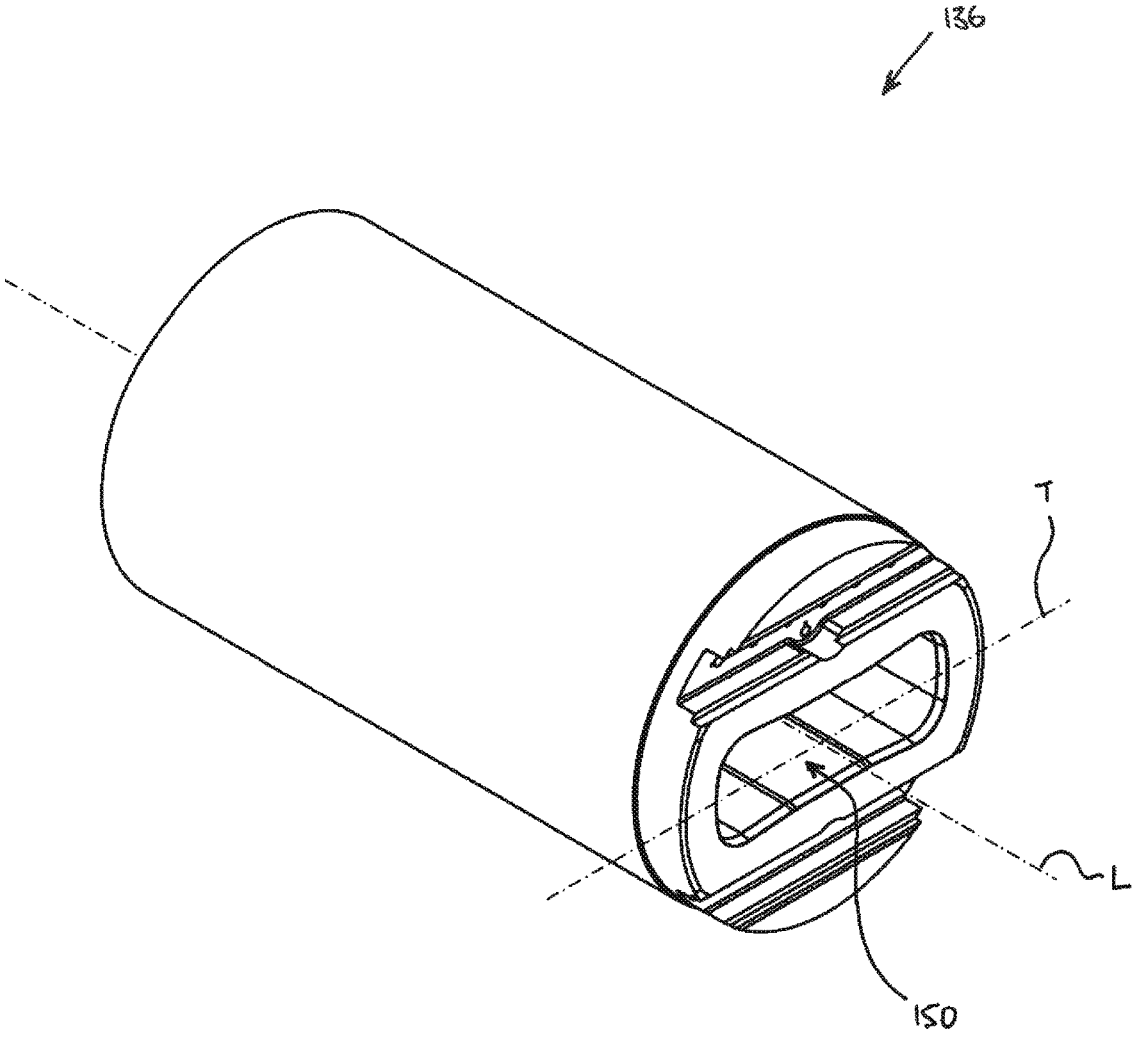
FIG. 7 is a perspective view of a liner forming part of the container of FIG. 4.
Figure 8:
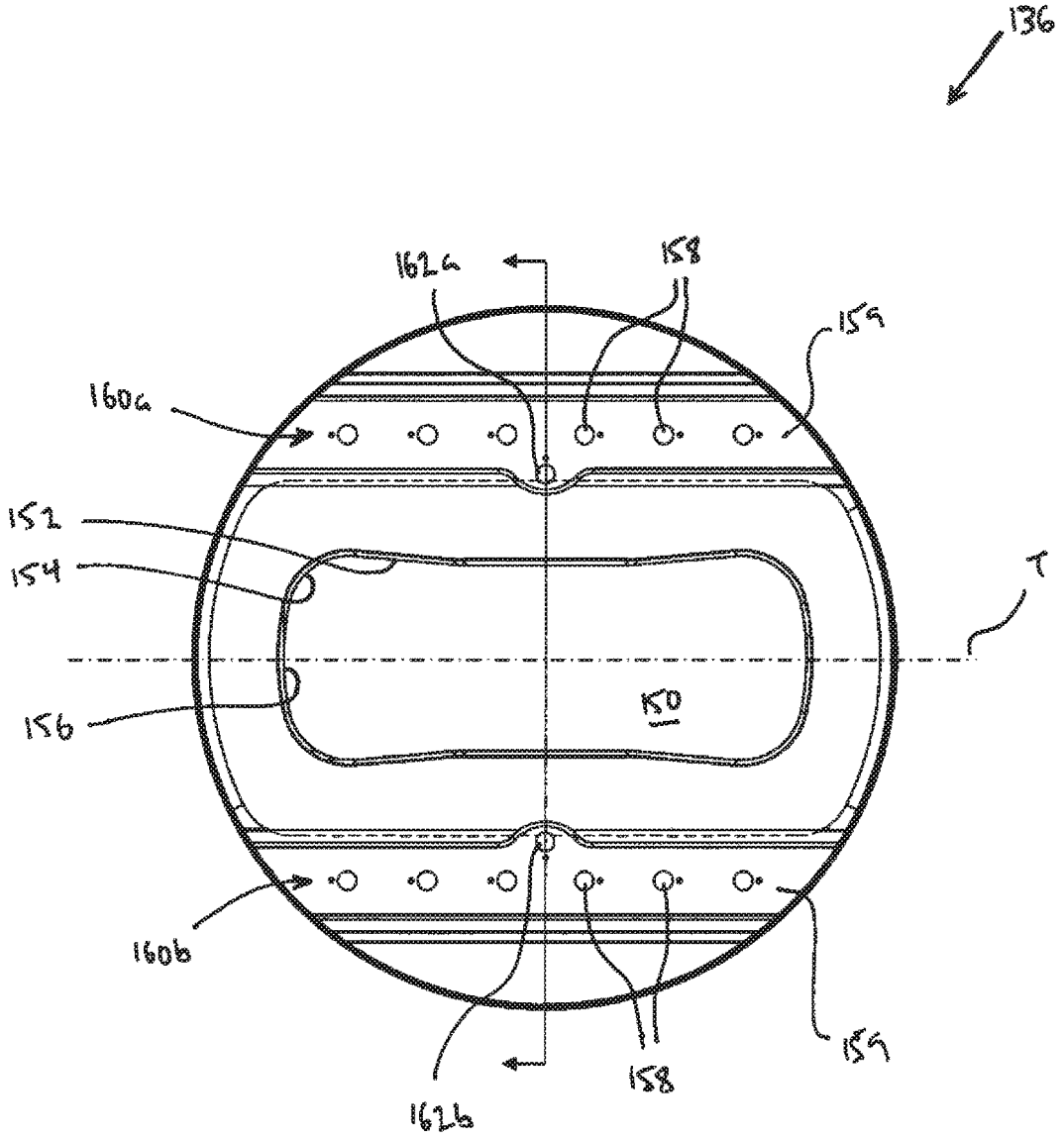
FIG. 8 is a front elevational view of the liner of FIG. 7.
Figure 9:
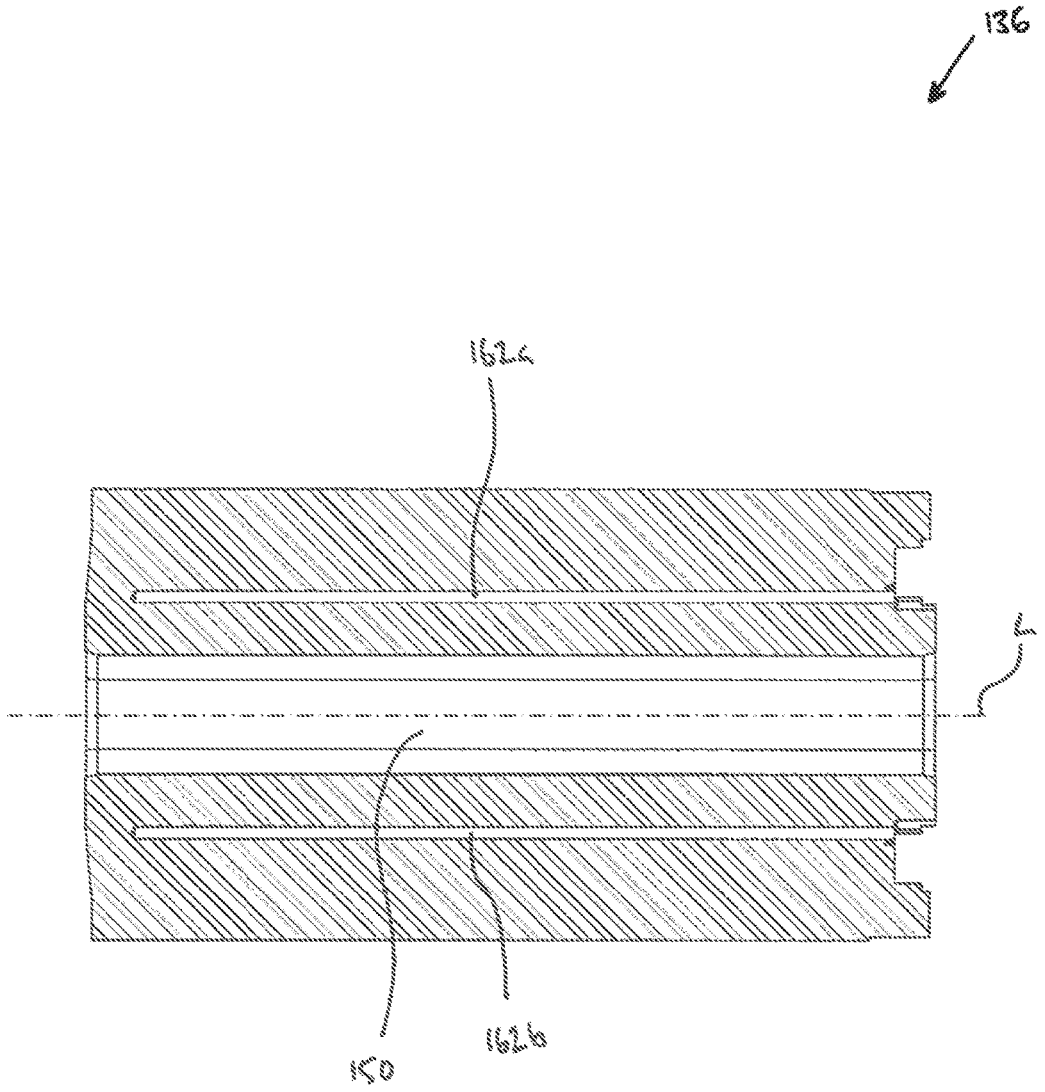
FIG. 9 is a side sectional view of the liner of FIG. 7, taken along the section line indicated in FIG. 8.

The liner 136 is better illustrated in FIGS. 7 to 9. Liner 136 comprises a billet receiving passage 150 that extends longitudinally therethrough and that defines a longitudinal axis, L. The passage 150 has a generally rectangular cross-sectional profile having a width defining a transverse axis, T. In this embodiment, the generally rectangular cross-sectional profile of the passage 150 comprises flared ends 152, rounded corners 154, and rounded sides 156. Surrounding the passage 150 is a plurality of longitudinal bores 158 extending partially into the length of the liner 136. The longitudinal bores 158 are provided within a pair of channels 159, with each channel having a depth equal to the depth of the annular recess 142. In this embodiment, the longitudinal bores 158 extend from the ram end 140 to approximately four (4) inches from the die end 138 of the liner 136. Each longitudinal bore 158 is also shaped to accommodate an elongate heating element 146 that can be energized to provide thermal energy to the liner 136 in the vicinity of the passage 150. In the embodiment shown, the liner 136 comprises twelve (12) longitudinal bores 158 arranged in two rows 160*a* and 160*b* that are parallel to, and on opposite sides of, the transverse axis T of the passage 150.

In this embodiment, container 130 also comprises a pair of longitudinal bores 162*a* and 162*b* extending partially into the length of the liner 136. Each longitudinal bore 162*a* and 162*b* is provided within a centrally located deviation of the channels 159, and is shaped to accommodate a temperature sensor (not shown). The longitudinal bores 162*a* and 162*b* are positioned in a manner so as to avoid intersecting any of the longitudinal bores 158, and in the embodiment shown, the longitudinal bores 162*a* and 162*b* are positioned on opposite sides of the transverse axis T of the passage 150, and each longitudinal bore 162*a* and 162*b* is centrally located and is positioned between the longitudinal bores 158 and the passage 150. The longitudinal bores 162*a* and 162*b* extend from the ram end 140 to approximately four (4) inches from the die end 138 of the liner 136. As will be appreciated, terminating the longitudinal bores 158, 162*a* and 162*b* at a distance from the die end 138 of the liner 136 advantageously strengthens the liner 136.

Figure 10:
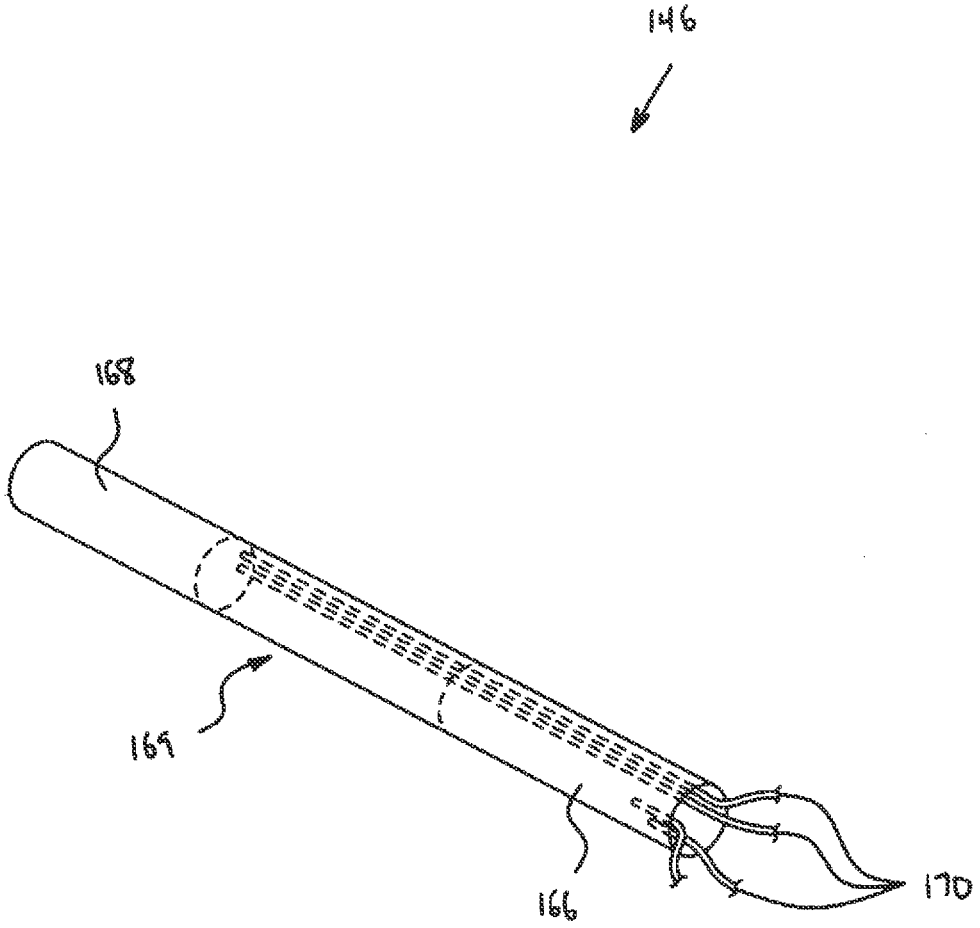
FIG. 10 is a perspective view of a heating element for use with the container of FIG. 4.

The elongate heating elements 146 are cartridge-type elements, as shown in FIG. 10. The regions of the container in greatest need of added temperature are generally the die end 138 and ram end 140, referred to as front 145*a* and rear 145*b* zones, respectively. As such, each of the heating elements may be configured with segmented heating regions. In this embodiment, and as shown in FIG. 10, each heating element is configured with a front heating section 166 and a rear heating section 168, which are separated by a central unheated section 169. To energize and control the heating elements, lead lines 170 feed to each heating section 166, 168. The lead lines connect to various bus lines (not shown), which in turn connect to a controller (not shown). The arrangement of the bus lines may take any suitable configuration, depending on the heating requirements of the container 30. In this embodiment, the bus lines are configured to selectively allow heating of the front zone 145*a* and rear zone 145*b* of the container, or more preferably just portions thereof, as deemed necessary by the operator. In this embodiment, the arrangement of lead lines enables each of the elongate heating elements 146 to be individually controllable, and also enables each of the heating sections 166, 168 within each elongate heating element 146 to be individually controllable. For example, the operator may routinely identify temperature deficiencies in a lower front zone 145*c* and a lower rear zone 145*e*. The elongate heating elements 146 in the vicinity of the lower front zone 145*c* and the lower rear zone 145*e* are configured to be controlled by the operator to provide added temperature when required. Similarly, the elongate heating elements 146 in the vicinity of an upper front zone 145*d* and an upper rear zone 145*f* are configured to be controlled by the operator to provide reduced temperature when required. It will also be appreciated that an operator can selectively heat zones so as to maintain a preselected billet temperature profile. For example, an operator may choose a billet temperature profile in which the temperature of the billet progressively increases towards the die end, but with a constant temperature profile across the cross-sectional area of the billet. This configuration is generally referred to as a "tapered" profile. Having the ability to selectively heat zones where necessary enables the operator to tailor and maintain a preselected temperature profile, ensuring optimal productivity.

To monitor the temperature of the extrusion process, temperature sensors (not shown) are used. In this embodiment, the temperature sensors are thermocouples. Each sensor comprises two sensing elements (not shown), one sensing element for placement in the front zone 145*a* of the liner 136, and the second sensing element for placement in the rear zone 145*b*. The sensors feed into the controller, providing the operator with temperature data from which subsequent temperature adjustments can be made.

In use, the liner 136 is oriented such that the transverse axis T of passage 150 is generally horizontal. In this orientation, rows 160*a* and 160*b* of longitudinal bores 158 accommodating the elongate heating elements are situated above and below the passage 150, respectively, and the longitudinal bores 162*a* and 162*b* accommodating the temperature sensors are situated above and below the passage 150, respectively. As will be appreciated, the positioning of temperature sensors both above and below the passage 150 advantageously allows the vertical temperature profile within the liner 136 to be measured, and moreover allows any vertical temperature difference across the passage 150 that arises during extrusion to be directly monitored by the operator. The positioning of elongate heating elements both above and below the passage 150 advantageously allows any measured vertical temperature difference to be reduced or eliminated by increasing the thermal energy supplied by elongate heating elements 146 positioned within row 160*b* below the passage 150, or by reducing the thermal supplied by elongate heating elements 146 positioned within row 160*a* above the passage 150, or by both. As each of the heating elements within the rows 160*a* and 160*b* are individually controllable, the thermal profile within the liner can be accurately controlled.

Those skilled in the art will appreciate that accurately controlling the thermal profile of the liner also allows the thermal profile of the extrusion die to be indirectly controlled, as the container and the extrusion die are in general thermal communication with each other by thermal conductance.

Additionally, the arrangement of the longitudinal bores 158 in rows 160*a* and 160*b* advantageously allows the thermal energy to be evenly distributed along the transverse axis T of the passage 150, which thereby improves the temperature uniformity across the width of the passage 150.

Those skilled in the art will appreciate that the inclusion of flared ends 152, rounded corners 154 and rounded sides 156 in the cross-sectional profile of the passage 150 advantageously reduces localized stresses in the liner 136 near the corners of the passage 150. This reduction in localized stresses reduces cracking in the liner in the vicinity of these corners. Such cracks can eventually propagate from the liner into the mantle, necessitating replacement of both the liner and the mantle and resulting in costly downtime. Accordingly, the cross-sectional profile of the passage 150 comprising flared ends 152, rounded corners 154 and rounded sides 156 enables the usage life of both the liner 136 and the mantle 132 to be extended.

Figure 11:
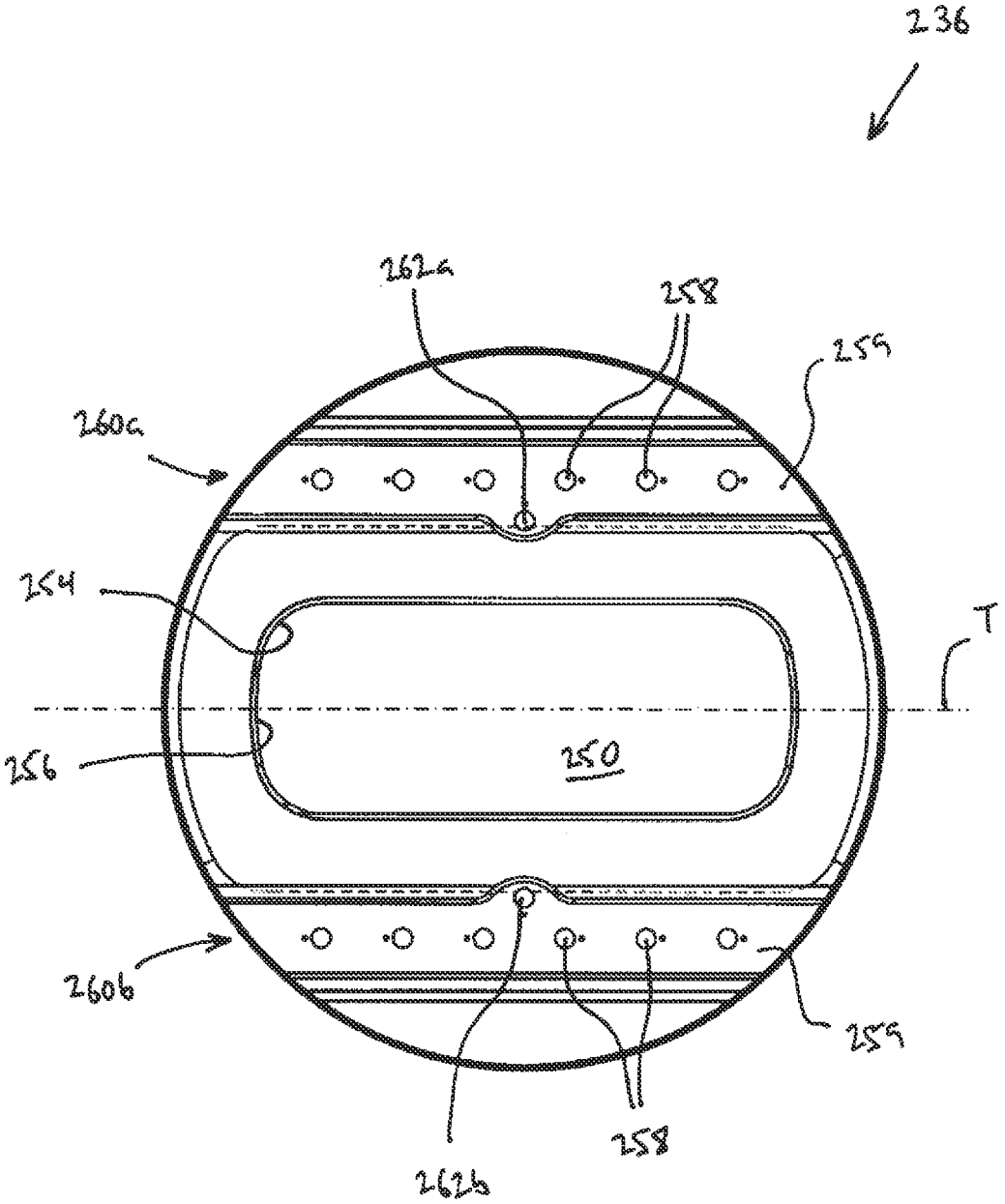
FIG. 11 is a front elevational view of another embodiment of a liner for an extrusion press container.

It will be understood that the liner is not limited to the configuration described above, and in other embodiments, the liner may alternatively have other configurations. For example, the liner may alternatively comprise a billet receiving passage having a generally rectangular cross-sectional profile that comprises any of flared ends, rounded corners, and rounded sides. FIG. 11 shows another embodiment of a liner that is generally indicated by reference numeral 236. Liner 236 is generally similar to liner 136 described above and with reference to FIGS. 7 to 9, and comprises a billet receiving passage 250 that extends longitudinally therethrough, and which defines a longitudinal axis, L. The passage 250 has a generally rectangular cross-sectional profile having a width defining a transverse axis, T. In this embodiment, the generally rectangular cross-sectional profile of the passage 250 comprises rounded corners 254 and rounded sides 256. Surrounding the passage 250 is a plurality of longitudinal bores 258 extending partially into the length of the liner 236, with the longitudinal bores 258 being provided within a pair of channels 259. In this embodiment, the longitudinal bores 258 extend from a ram end 240 of the liner 236 to approximately four (4) inches from a die end 238 of the liner 236. In the embodiment shown, the liner 236 comprises twelve (12) longitudinal bores arranged in two rows 260*a* and 260*b* parallel to the transverse axis T of the passage 250. Each longitudinal bore 258 is also shaped to accommodate an elongate heating element 146 that can be energized to provide thermal energy to the liner 236 in the vicinity of the passage 250. Liner 236 further comprises a pair of longitudinal bores 262*a* and 262*b* extending partially into the length of the liner 236 and being positioned adjacent opposing sides of the passage 250. Each longitudinal bore 262*a* and 262*b* is provided within a centrally located deviation of the channels 259, and is shaped to accommodate a temperature sensor. In this embodiment, each longitudinal bore 262*a* and 262*b* is positioned between the longitudinal bores 258 and the passage 250. The longitudinal bores 262*a* and 262*b* extend from the ram end 240 to approximately four (4) inches from the die end 238 of the liner 236.

Although in the embodiments described above, the liner comprises twelve (12) longitudinal bores each for accommodating an elongate heating element, in other embodiments, the liner may alternatively comprise more or fewer longitudinal bores each for accommodating an elongate heating element.

Although in embodiments described above, the longitudinal bores for accommodating elongate heating elements in the liner are arranged in two rows and parallel to, and on opposite sides of, the transverse axis T of the passage, in other embodiments, the longitudinal bores for accommodating elongate heating elements in the liner may alternatively be arranged in other arrangements within the liner.

Although in embodiments described above, the longitudinal bores for the elongate heating elements and the longitudinal bores for the temperature sensors extend partially into the length of the liner, in other embodiments, any of the longitudinal bores for the elongate heating elements and the longitudinal bores for the temperature sensors may alternatively extend the entire length of the liner.

Although in embodiments described above, the elongate heating elements are configured with front heating sections and rear heating sections, in other embodiments, the elongate heating elements may alternatively be configured with additional or fewer heating sections, and/or may alternatively be configured to heat along the entire length of the heating cartridge.

Although in embodiments described above, the elongate heating elements in the vicinity of the lower front zone and the lower rear zone are described as being configured to be controlled by the operator to provide added temperature, it will be understood that these elongate heating elements are also configured to be controlled by the operator to provide reduced temperature. Similarly, although in embodiments described above, the elongate heating elements in the vicinity of the upper front zone and the upper rear zone are described as being configured to be controlled by the operator to provide reduced temperature, it will be understood that these elongate heating elements are also configured to be controlled by the operator to provide added temperature.

Although in embodiments described above, the liner comprises two (2) longitudinal bores for accommodating temperature sensors, in other embodiments, the liner may alternatively comprise more or fewer longitudinal bores for accommodating temperature sensors. In still other embodiments, the liner may alternatively comprise no longitudinal bores and for accommodating temperature sensors, and in such embodiments, the liner may comprise one or more radial bores for accommodating temperature sensors.

Although in embodiments described above, each longitudinal bore for the temperature sensors is positioned between the longitudinal bores for the elongate heating elements and the passage, in other embodiments, one or more of the longitudinal bores for the temperature sensors may alternatively be positioned elsewhere within the liner.

Although in embodiments described above, the temperature sensor contains two sensing elements, in other embodiments, the temperature sensor may alternatively comprise any number of sensing elements.

Although in embodiments described above, in use, the liner is configured to be oriented such that the transverse axis T of the passage is generally horizontal, it will be understood that the liner may alternatively be used with the transverse axis T of the passage oriented in any direction.

Although embodiments have been described above with reference to the accompanying drawings, those of skill in the art will appreciate that variations and modifications may be made without departing from the scope thereof as defined by the appended claims.

What is claimed is:

1. A liner for an extrusion press container, the extrusion press container being configured to be coupled to an extrusion die, the liner comprising:

an elongate body having a longitudinally extending passage therein through which a billet is advanced, said passage extending in a longitudinal direction, said passage having a generally rectangular cross-sectional profile and having opposing sides that are parallel along generally the length of the passage;

at least one first longitudinally extending heating element accommodated in said elongate body adjacent a first side of said passage and at least one second longitudinally extending heating element accommodated in said elongate body adjacent a second side of said passage, said first and second longitudinally extending heating elements being individually controllable for controlling a thermal profile within the liner; and at least one first longitudinally extending temperature sensor adjacent the first side of said passage and extending in the longitudinal direction, and at least one second longitudinally extending temperature sensor adjacent the second side of said passage and extending in the longitudinal direction, wherein said temperature sensors are accommodated in said elongate body, said passage of said elongate body having a surface contacting said billet during extrusion.

2. The liner of claim 1, wherein said generally rectangular cross-sectional profile of said passage has a width defining a transverse axis, said first and second longitudinally extending heating elements being positioned on opposite sides of said transverse axis.

3. The liner of claim 2, wherein said first and second longitudinally extending heating elements are arranged in at least one row adjacent said passage.

4. The liner of claim 3, wherein said at least one row is parallel to said transverse axis.

5. The liner of claim 1, wherein said at least one first longitudinally extending temperature sensor is positioned between said at least one first longitudinally extending heating element and said passage.

6. The liner of claim 1, wherein said at least one second longitudinally extending temperature sensor is positioned between said at least one second longitudinally extending heating element and said passage.

7. The liner of claim 1, wherein said first and second longitudinally extending temperature sensors are thermocouples.

8. The liner of claim 1, wherein said generally rectangular cross-sectional profile comprises rounded corners.

9. The liner of claim 8, wherein said generally rectangular cross-sectional profile comprises rounded sides.

10. The liner of claim 9, wherein said generally rectangular cross-sectional profile comprises flared ends.

11. The liner of claim 1, wherein at least one of said first and second longitudinally extending heating elements comprises at least one heating section.

12. The liner of claim 1, wherein each of said first and second longitudinally extending heating elements comprises two heating sections positioned towards each relative end of the heating element.

13. A container for use in a metal extrusion press, the container being configured to be coupled to an extrusion die, the container comprising:

an outer mantle configured for connecting to an extrusion press and having a central axial bore therein; and a liner comprising an elongate body having a longitudinally extending passage therein through which a billet is advanced, said passage extending in a longitudinal direction, said passage having a generally rectangular cross-sectional profile and having opposing sides that are parallel along generally the length of the passage, and at least one first longitudinally extending heating element accommodated in said elongate body adjacent a first side of said passage and at least one second longitudinally extending heating element accommodated in said elongate body adjacent a second side of said passage, said first and second longitudinally extending heating elements being individually controllable for controlling a thermal profile within the liner, the liner further comprising at least one first longitudinally extending temperature sensor adjacent the first side of said passage and extending in the longitudinal direction, and at least one second longitudinally extending temperature sensor adjacent the second side of said passage and extending in the longitudinal direction, wherein said temperature sensors are accommodated in said elongate body having a surface contacting said billet during extrusion.

14. The container of claim 13, wherein said generally rectangular cross-sectional profile of said passage has a width defining a transverse axis, said first and second longitudinally extending heating elements being positioned on opposite sides of said transverse axis.

15. The container of claim 14, wherein said first and second longitudinally extending heating elements are arranged in at least one row adjacent said passage.

16. The container of claim 15, wherein said at least one row is parallel to said transverse axis.

17. The container of claim 13, wherein said at least one first longitudinally extending temperature sensor is positioned between said at least one first longitudinally extending heating element and said passage.

18. The container of claim 13, wherein said at least one second longitudinally extending temperature sensor is positioned between said at least one second longitudinally extending heating element and said passage.

19. The container of claim 13, wherein said first and second longitudinally extending temperature sensors are thermocouples.

20. The container of claim 13, wherein said generally rectangular cross-sectional profile comprises rounded corners.

21. The container of claim 20, wherein said generally rectangular cross-sectional profile comprises rounded sides.

22. The container of claim 21, wherein said generally rectangular cross-sectional profile comprises flared ends.

23. The container of claim 13, wherein at least one of said first and second longitudinally extending heating elements comprises at least one heating section.

24. The container of claim 13, wherein each of said first and second longitudinally extending heating elements comprises two heating sections positioned towards each relative end of the heating element.

25. The container of claim 13, wherein the outer mantle comprises a plurality of additional longitudinally extending heating elements adjacent said liner.

26. The container of claim 25, wherein the plurality of additional longitudinally extending heating elements is arranged circumferentially about the central axial bore of the outer mantle.

27. The container of claim 13, wherein the liner further comprises at least one of the following:

a) at least one first temperature sensor positioned between said at least one first longitudinally extending heating element and said passage;

b) at least one second temperature sensor positioned between said at least one second longitudinally extending heating element and said passage, wherein the outer mantle comprises a plurality of additional longitudinally extending heating elements arranged circumferentially about the central axial bore of the outer mantle.

28. The container of claim 27, wherein the outer mantle is a unitary member.

* * * * *